United States Patent [19]

Burson

[11] 3,955,549

[45] May 11, 1976

[54] CD IGNITION SYSTEM WITH ANTI-REVERSE FEATURE

[75] Inventor: Bob O. Burson, East Longmeadow, Mass.

[73] Assignee: R. E. Phelon Company, Inc., East Longmeadow, Mass.

[22] Filed: Oct. 29, 1974

[21] Appl. No.: 518,569

[52] U.S. Cl. ..... 123/148 CC; 123/148 S; 123/198 DC

[51] Int. Cl.[2] ..... F02P 1/00

[58] Field of Search..... 123/148 E, 148 MC, 149 A, 123/149 C, 149 F, 148 S, 198 DC, 149 R

[56] References Cited

UNITED STATES PATENTS

| | | | |
|---|---|---|---|
| 3,405,347 | 10/1968 | Swift et al. | 123/148 MC |
| 3,545,420 | 12/1970 | Foreman | 123/148 MC |
| 3,554,179 | 1/1971 | Burson | 123/148 MC |
| 3,722,488 | 3/1973 | Swift et al. | 123/148 MC |

*Primary Examiner*—Charles J. Myhre
*Assistant Examiner*—Ronald B. Cox
*Attorney, Agent, or Firm*—McCormick, Paulding & Huber

[57] ABSTRACT

A capacitor-discharge ignition system for a two-stroke internal combustion engine has a trigger coil which during forward rotation of the crankshaft discharges a capacitor through the primary coil of an ignition transformer to produce an appropriately timed ignition spark. The discharge and spark occur when a magnet mounted on the flywheel of the engine intercepts the trigger coil at a crankshaft or piston position in the vicinity of top dead center. The trigger coil discharges the capacitor by supplying a trigger signal to the control gate of a silicon controlled rectifier (SCR) located in the discharging path between the capacitor and the primary coil of the ignition transformer. The primary coil, which is connected to the cathode of the SCR, is mounted on a stator core intercepted by the magnet on the flywheel no less than 60° after top dead center. If, for any reason, the crankshaft of the engine should be rotated in the reverse direction, the voltage induced in the primary coil by the magnet reduces the gate-to-cathode bias on the SCR and causes any charge on the capacitor to discharge through the primary. Any ignition spark created is too far in advance of the top dead center position and sustained engine operation in the reverse direction, therefore, is inhibited.

11 Claims, 5 Drawing Figures

CD IGNITION SYSTEM WITH ANTI-REVERSE FEATURE

BACKGROUND OF THE INVENTION

The present invention relates to a capacitor-discharge (CD) ignition system for two-stroke internal combustion engines. More particularly, the present invention is related to a CD ignition system which inhibits sustained engine operation in the event that the crankshaft is rotated in a reverse direction, that is, the direction opposite that contemplated by the engine design and associated mechanism connected to the crankshaft of the engine.

Due to the peculiar operation of a two-stroke internal combustion engine, it is possible to start the engine and to sustain engine operation with the crankshaft rotating in either a forward or a reverse direction. In this respect, the terms "forward" and "reverse" are utilized for convenience to differentiate between the two possible directions of crankshaft rotation. Normally, the engine is designed to operate in the "forward" direction and the ignition system is optimumly timed to fire the spark plug slightly in advance of the top dead center position of the piston and crankshaft. Since the plug fires in the vicinity of top dead center position, however, and because the two piston strokes of the engine cycle are carried out in the same manner regardless of which direction of the crankshaft is rotated, it is possible to have sustained engine operation for both forward and reverse crankshaft rotations.

CD ignition systems have anti-reverse features which prevent the engine from continuing to operate in the reverse direction already exist in the prior art. U.S. Pat. No. 3,554,179 issued Jan. 12, 1971 to the Assignee of the present invention discloses a CD ignition system in which a trigger signal energizing a silicon control rectifier is derived from a trigger coil excited by first flux-varying element carried on a flywheel of the engine. The first flux-varying element is positioned on the flywheel to discharge the capacitor and produce an ignition spark at an appropriate time during the enginge cycle, that is, in the vicinity of top dead center during forward rotation of the crankshaft. A second flux-varying element is almost mounted on the flywheel at a position circumferentially displaced from the first element and the second element discharges the capacitor and produces a spark when the crankshaft rotates in the reverse direction. The spark produced by the second element, however, is timed to occur during the engine cycle so far in advance of the top dead center position that sustained engine operation is inhibited.

While the use of two-flux varying elements is feasible in a CD ignition system to produce an anti-reverse feature, it has been discovered that the anti-reverse feature can also be derived from a system having only a single-flux varying element.

It is, accordingly, an object of the present invention to disclose a CD ignition system with an anti-reverse feature that requires only one flux-varying element to produce an appropriately timed spark for maintaining engine operation during forward crankshaft rotation and to discharge the capacitor without maintaining engine operation during reverse crankshaft rotation.

SUMMARY OF THE INVENTION

The present invention resides in a capacitor-discharge ignition system for a two-stroke internal combustion engine having a crankshaft through which the engine power is derived, a spark plug for igniting a combustible mixture within the engine and a member such as a flywheel rotated in synchronism with the crankshaft so that the member rotates once with each revolution of the crankshaft and in synchronism with the engine cycle.

The ignition system includes an ignition transformer having a primary coil inductively coupled with a secondary coil for stepping up electrical voltage to sparking potential. A capacitor is connected for timed discharging through the primary coil of the ignition transformer to produce the spark potential in the secondary coil and the ignition spark at the plug. Triggering means is connected with the capacitor and includes a flux-varying element, such as a magnet mounted on the rotated member, and a trigger coil for producing a first trigger signal to discharge the capacitor during forward rotation of the engine crankshaft at a time which sustains engine operation. The first trigger signal occurs as the flux-varying element and the trigger coil are moved past one another and the rotated member is in the vicinity of the top dead center position of the crankshaft with a combustible mixture compressed in the combustion chamber of the engine.

Suppressing means are also connected with the capacitor and include the primary coil of the ignition transformer for producing a second trigger signal in timed relationship with reverse rotation of the crankshaft. The second trigger signal also discharges the capacitor through the primary coil but at a time during the engine cycle, for example, no less than 60° from top dead center, that inhibits rather than sustains engine operation.

By timing the discharge of the capacitor as described during forward and reverse rotations of the crankshaft, engine operation is sustained only when the crankshaft rotates in a forward direction as contemplated. Inadvertent and sustained engine operation in the reverse direction is prevented.

DESCRIPTION OF THE PREFERRED EMBODIMENTS

Figure 1:
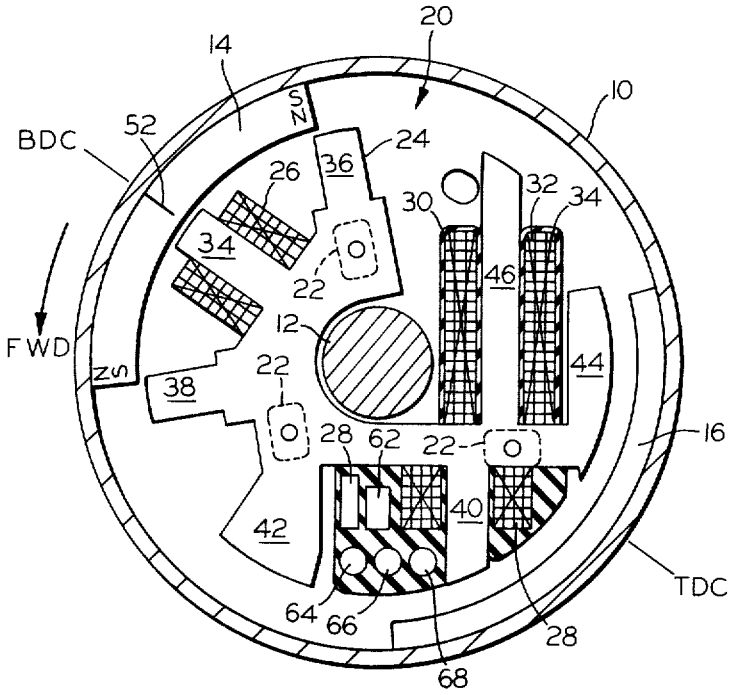
FIG. 1 is a sectional view of the rotor and stator assemblies of an ignition system forming one embodiment of the present invention.

FIG. 1 illustrates in section the rotor and stator assemblies comprising one embodiment of the present invention. The rotor assembly including a rotor, generally designated 10, forms part of a flywheel or other rotated member (not shown) coaxially connected to the crankshaft 12 of a two-stroke internal combustion engine so that the rotor turns at the same speed as the crankshaft and in synchronism with the two-stroke engine cycle. The rotor need not form part of the flywheel and, instead, may simply be connected directly to the crankshaft as a component of the ignition system.

An arcuate-shaped flux-varying element or magnet 14 is fixedly secured to the inner periphery of the rotor 10 at one side, and an arcuate-shaped counterweight 16 is secured to the inner periphery of the rotor at the side diametrically opposite the magnet. The counterweight is designed to match the mass of the magnet 14 so that the rotor assembly including the rotor 10, the magnet 14 and the counterweight 16 is dynamically balanced at high speed.

The magnet 14 is preferably a ceramic magnet having permanent, radially disposed north and south poles at the arcuate ends as illustrated. With such poles, the rotor 10 is preferably formed of a ferromagnetic material for completing the magnetic flux path between the poles and stator cores mounted within the rotor as described in greater detail below.

The stator assembly, generally designated 20, is mounted on the engine housing by means of stand-offs 22 so that the assembly is disposed coaxially of the crankshaft 12 and within the rotor 10. The stator assembly is comprised primarily of laminated ferromagnetic plates 24 (only one visible) having the same shape and stacked one upon the other to form a module supporting structure as well as a series of circumferentially spaced stator cores for electrical coils and components within the rotor. The assembly includes a charging coil 26, a trigger coil 28 and an ignition transformer 30. The charging coil 26 is mounted on the plates 24 at one station within the rotor. In a similar fashion, the trigger coil 28 is mounted at another station on the plates and the ignition transformer 30 comprised of a primary coil 32 and a secondary coil 34 is mounted at still another location on the plates.

The irregular shape of the plates 24 is intended to provide each of the coils 26, 28 and 30 with a properly located E-shaped stator core in which time-varying magnetic flux fields are cyclically induced by the flux-varying element or magnet 14. In particular, the charging coil 26 is mounted on the central leg 34 of an E-shaped core including outer legs 36 and 38. The trigger coil 28 is mounted on the central leg 40 of an E-shaped core including the outer legs 42 and 44, and the primary and secondary coils 32 and 34 of the ignition transformer 30 are mounted on the central leg 46 of an E-shaped core including the outer legs 44 and 36. It is apparent that each of the E-shaped stator cores has one of its outer legs common to one of the other cores, and that the core for the ignition transformer 30 shares both of its outer legs 36 and 44 with the other cores. Such an arrangement of the cores provides a compact unit for installation within the rotor 10 and makes assembly of the unit simpler than that involving a plurality of individual cores for each of the separate coils.

The size of the pole faces on the center legs of each of the cores and the spacing of the outer legs from the center legs are the same on each of the cores for cooperation with the magnet 14. For example, with the rotor in the position illustrated in FIG. 1, the magnet 14 is centrally located over the central leg 34 and the circumferential ends of the magnet slightly overlap the pole faces on the outer legs 36 and 38 respectively. This centered position of the magnet over the stator core corresponds to the position of the rotor at which maximum change in flux through the center leg of the core occurs and, correspondingly, maximum current is induced in the associated coil mounted on the leg. The same positional relationship of the magnet 14 is illustrated for the cores of the trigger coil 28 and the ignition transformer 30 in FIGS. 3 and 4 respectively. The geometric correspondence of the magnet and each of the stator cores is desirable for maximum current induction in each of the respective coils 26, 28 and 32.

Figure 3:
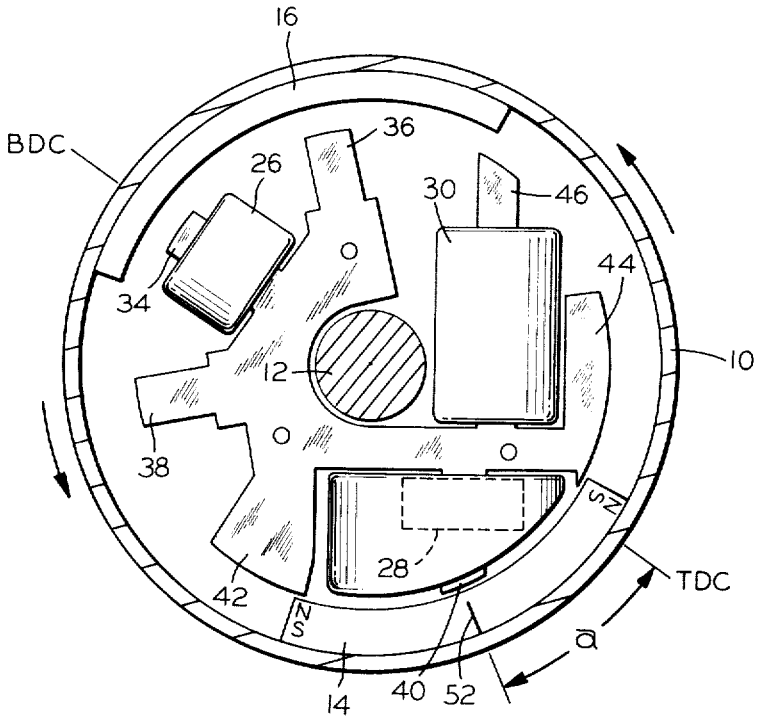
FIG. 3 is a sectional view of the ignition system showing the position of the rotor assembly at the time an ignition spark is generated during forward rotation of the crankshaft.
Figure 4:
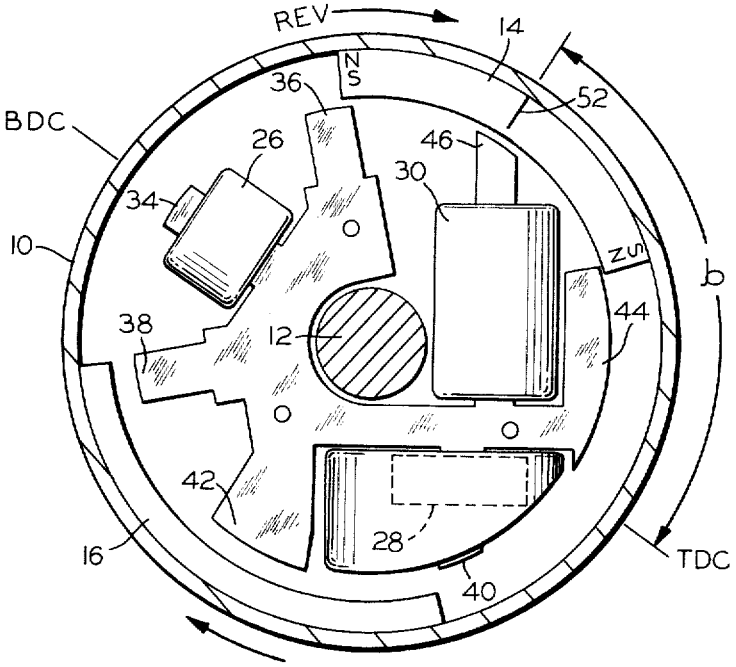
FIG. 4 is a sectional view of the ignition system showing the position of the rotor assembly when the capacitor is discharged during reverse rotation of the crankshaft.

The circumferential positioning of the plates 24 and associated coil cores in the stator assembly relative to the magnet and the engine housing on which the stator assembly is mounted is established to cause the magnet 14 to intercept the respective cores and produce currents or voltages in the respective coils at specified times during the engine cycle. It is assumed that the engine cycle begins when the piston is at its bottom dead center (BDC) position and the crankshaft 12 and rotor 10 are in the positions illustrated in FIG. 1 relative to the stator assembly. Note that the index mark 52 on the magnet 14 is aligned with the BDC index mark on the housing of the engine indicating the bottom dead center position. As the rotor 20 moves with the crankshaft 12 in the forward or counter-clockwise direction identified by the arrow in FIG. 1, the magnet 14 moves from the stator core of the charging coil 26 to the stator core on which the trigger core 28 is mounted to produce a first triggering signal for substantially simultaneous generation of an ignition spark from the ignition transformer 30 as described below. The position of the magnet 14 when a trigger signal is produced is illustrated in FIG. 3 and it is apparent that the trigger signal and ignition spark are timed to occur prior to the piston and crankshaft reaching the top dead center (TDC) positions identified by the TDC index mark. The advance angle $a$, generally not greater than 35°, indicates that displacement through which the magnet must move before the piston and the crankshaft have reached the top dead center position. Combustion, therefore, is initiated prior to top dead center, but due to the slow flame propagation rate within the combustion chamber, burning of the gases is not completed until well after the piston has passed top dead center. Expanding gases in the engine cylinder continue to propel the cranshaft and the rotor 10 in the counter-clockwise direction as the engine completes its cycle and the crankshaft returns to the bottom dead center position. In single-cylinder engines, the momentum of the flywheel connected to the crankshaft initiates another engine cycle. One cycle follows another as long as fuel is provided to the engine and the ignition spark is provided at the appropriate time.

Figure 2:
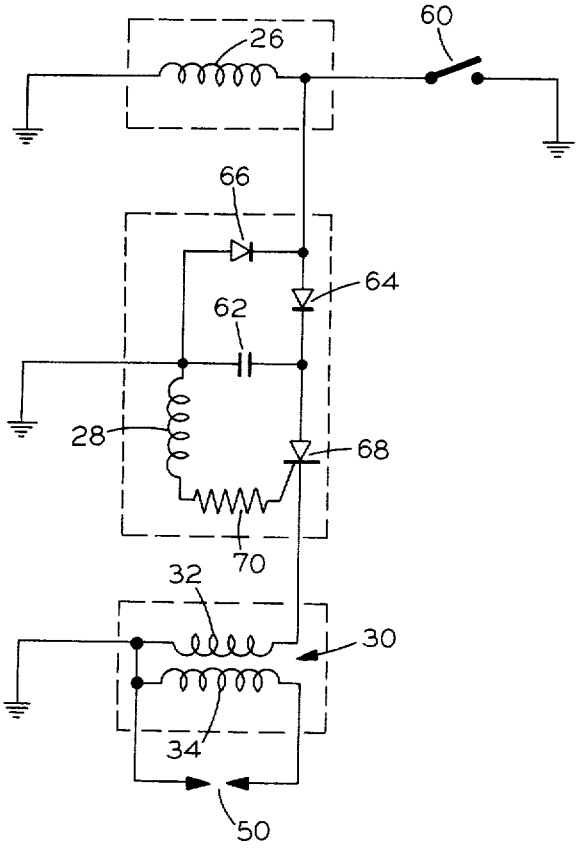
FIG. 2 is an electrical diagram illustrating the electrical components in the ignition system in FIG. 1.

To produce the correctly timed ignition spark during forward rotation, the electrical components of the stator assembly are connected together to form the CD ignition system shown in FIG. 2. The components are mounted as modules, potted if so desired, in the stator assembly, the components in each module being identified in FIG. 2 within the dotted boxes. The charging coil 26 is permanently grounded at one end and is connected at the opposite end to an on-off switch 60. When the engine is to be shut off, the switch 60 is closed and grounds the end of the coil 26 connected to the remainder of the ignition system to prevent the generation of the necessary ignition spark.

Figure 5:
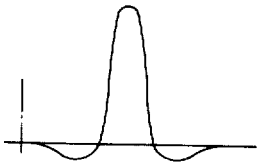
FIG. 5 is a graph illustrating the variation of current in a coil on an E-shaped stator core as the core and a flux-varying element are moved by one another.

When the switch 60 is opened as illustrated, the coil 26 charges a capacitor 62 as the magnet 14 (FIG. 1) traveling on its circular path about the stator assembly intercepts the stator core on which the charging coil 26 is mounted near bottom dead center. An exemplary current induced in the coil 26 is illustrated in FIG. 5. The large positive pulse coincides with the position of the magnet 14 illustrated in FIG. 1 and it will be observed in FIG. 5 that small negative currents are produced in the coil immediately preceding and following the positive current pulse. To insure that the capacitor 62 acquires and holds a maximum charge from the positive pulse, the diodes 64 and 66 are provided.

The triggering coil 28 is connected to the gate of a silicon controlled rectifier (SCR) 68 through a resistor 70. The anode of the SCR is connected to the capacitor 62 and the cathode is connected to the primary coil 32 of the ignition transformer 30. When the magnet 14 intercepts the stator core for the triggering coil 28 as illustrated in FIG. 3, the coil produces a first triggering signal in the form of a current pulse, similar to that illustrated in FIG. 5, which is transmitted through the resistor 70 and the SCR gate to place the SCR 68 in the conductive state. The charge on the capacitor 62 is immediately discharged through the SCR 68 and the primary coil 32 of the ignition transformer 30. The secondary coil 34 steps up the primary voltage to sparking potential and the ignition spark is produced across the electrodes of the spark plug 50.

It should be noted that the SCR 68 is turned on when the gate-to-cathode bias is positive, and the rectifier remains turned on until the anode-to-cathode potential returns substantially to zero. This potential reverses during discharging as a result of resonance between the capacitor 62 and the primary coil 32 so that the SCR is placed in the non-conductive state after discharge in preparation for the next engine cycle. Such operation of the ignition system continues cyclically during forward rotation of the crankshaft and sustains engine operation as long as ignition occurs in the vicinity of the top dead center position.

If the crankshaft should inadvertently be rotated in the reverse direction, for example during starting, it is possible that engine operation might be sustained by the triggering signal of the coil 28 even though such signal occurs slightly after top dead center with reverse rotation. To inhibit such reverse engine operation, the ignition transformer 30 is mounted on a stator core which is also inductively coupled with the magnet 14 when the magnet assumes the position shown in FIG. 4. The magnet 14 and the primary coil 32 of the transformer are so polarized that reverse rotation of the crankshaft and rotor 10 induces a second trigger signal, preferably the voltage form of FIG. 5 inverted, across the primary which substantially reduces the potential on the cathode of the SCR 68 and, correspondingly, produces a forward gate-to-cathode bias which places the SCR in the conductive state. Any charge developed on the capacitor 62 is immediately discharged through the primary coil 32 which produces a spark at the electrodes of the spark plug 50 assuming that an adequate charge has accumulated on the capacitor 62.

The stator core on which the ignition transformer 30 is mounted is so positioned on the stator assembly 20 that the spark produced by the second trigger signal during reverse rotation occurs at a point in the engine cycle that is too far in advance of top dead center to sustain engine operation. In particular, the central leg 46 of the stator core is circumferentially spaced from the top dead center position by an angle b in FIG. 4 no less than 60° and preferably 90° or more up to a limit set by the location of the charging coil 26. With such an advanced spark during reverse engine rotation, the magnet 14 may pass the charging coil 26 to establish a charge in the capacitor 62, but there is insufficient momentum in the crankshaft, piston and flywheel to carry the piston through the top dead center position in opposition to any combustion that is caused by the spark. As a result, rotation of the crankshaft in the reverse direction is halted and reverse engine operation is inhibited. The mounting of the ignition transformer 30 on the stator core as described, therefore, effectively suppresses reverse rotation.

It should be noted that the magnet 14 also intercepts the stator core of the ignition coil 30 during forward rotation and may suppress the potential on the cathode of SCR 68 to a point which also places the SCR in a conducting state. However, since the capacitor 62 has already been discharged at this point in the engine cycle, no spark is produced and even if a spark were produced it would be of no consequence since combustion will have already been in progress.

While the present invention has been described in a preferred embodiment, it should be understood that numerous substitutions and modifications can be made without departing from the spirit of the invention. For example, the outer legs 36 and 38 of the E-shaped core on which the charging coil 26 is mounted may be provided with additional coils for generating auxiliary electric power. In this connection, an additional magnet following the magnet 14 can be added to the rotor 10 to assist in generating the auxiliary power. The magnet 14 need not be a ceramic magnet that is radially polarized since a magnet having opposite poles at its circumferentially opposite ends respectively is functionally equivalent to the magnet illustrated. A circumferentially polarized magnet also does not require that the rotor 10 be ferromagnetic. Accordingly, the present invention has been described in a preferred embodiment by way of illustration rather than limitation.

I claim:

1. In a capacitor-discharge ignition system for a two-stroke internal combustion engine having a crankshaft, a spark plug for ignition and a member rotated in synchronism with the crankshaft and the engine cycle, the combination comprising:

an ignition transformer having a primary coil and a secondary coil for producing a spark voltage for the spark plug;

a capacitor connected for timed discharging through the primary coil of the ignition transformer;

means for charging the capacitor during each engine cycle;

switching means connected between the capacitor and the primary coil of the transformer and activated by trigger signals to establish an electrical discharge path between the capacitor and the primary coil of the ignition transformer;

triggering means connected with the switching means and including flux-varying means and a trigger coil for producing a first trigger signal from the trigger coil to actuate the switching means and discharge the capacitor through the primary coil in timed relationship with forward rotation of the engine crankshaft to sustain the engine operation, the flux-varying means and the trigger coil being selectively positioned relative to one another in the engine for movement past one another by the rotated member during each rotation of the engine crankshaft to produce the first trigger signal; and suppressing means connected with the switching means and including the primary coil of the ignition transformer and the flux-varying means, the primary coil and the flux-varying means also being selectively positioned relative to one another in the engine for movement past one another by the rotated member during each rotation of the engine crankshaft for producing a second trigger signal from the primary coil to actuate the switching means and discharge the capacitor through the primary coil in timed relationship with reverse rotation of the engine crankshaft to inhibit engine operation.

2. In a capacitor-discharge ignition system, the combination of claim 1 wherein:

the primary coil of the ignition transformer is mounted on a stator core; and the flux-varying element in the triggering means is mounted on the rotated member for cyclic movement past the stator core in synchronism with crankshaft rotation.

3. In a capacitor-discharge ignition system, the combination of claim 2 wherein:

the flux-varying element is a magnet mounted on the rotated member for inducing flux changes in the stator core.

4. The combination of claim 1 wherein:

the switching means comprises a silicon controlled rectifier having an anode and cathode connected respectively to the capacitor and the primary coil and a control gate connected with the trigger coil, whereby gate-to-cathode bias establishing a discharge path through the rectifier is produced by the trigger coil and the primary coil.

5. The combination of claim 4 wherein:

the primary coil is mounted on the central leg of an E-shaped stator core and is connected with the cathode of the silicon controlled rectifier to increase the gate-to-cathode bias when the flux-varying element passes adjacent the stator core on reverse rotation of the crankshaft.

6. The combination of claim 1 wherein:

the flux-varying means is mounted on the rotated member;

the trigger coil is mounted on a stator core at a location adjacent the rotating member to provide the first trigger signal at a crankshaft rotational position no more than 35° before top dead center during forward rotation of the crankshaft; and the primary coil is mounted on a stator core at a location adjacent the rotating member to provide the second trigger signal at a crankshaft rotational position no less than 60° before top dead center during reverse rotation of the crankshaft.

7. The combination of claim 1 wherein:

the flux-varying means is mounted on the rotating member for cyclic movement on a circular path in synchronism with the engine cycle;

the means for charging includes a charging coil mounted on a stator core adjacent the circular path and connected with the capacitor for cooperation with the flux-varying means and for charging the capacitor during each engine cycle;

the primary coil of the ignition transformer is also mounted on a stator core for cooperation with the flux-varying means during reverse rotation of the crankshaft; and the trigger coil is mounted on a stator core for cooperation with the flux-varying means.

8. The combination of claim 7 wherein:

the flux varying means include a magnet; and the stator cores for the charging coil, the triggering coil and the primary coil of the ignition transformer are E-shaped cores and the spacing between the pole faces of each core is the same on all of the cores.

9. The combination of claim 7 wherein:

the flux-varying means includes a magnet; and the stator cores for the charging, triggering and primary coils are E-shaped cores and each of the cores has one leg which is common to at least one of the other cores.

10. The combination of claim 9 wherein:

the E-shaped core of the primary coil has each of its outer legs common to one of the other cores.

11. The combination of claim 7 wherein:

the stator core for the trigger coil is mounted for intercepting the flux-varying means on the circular path in the vicinity of the top dead center position of the crankshaft;

the stator core for the primary coil is mounted for intercepting the flux-varying means on the circular path no less than 60° after top dead center position during forward rotation of the crankshaft; and the stator core for the charging coil is mounted for intercepting the flux-varying means on the portion of the circular path leading from the primary coil core to the trigger coil core in the forward direction of the crankshaft rotation.

* * * * *